US006851826B2

(12) United States Patent
James

(10) Patent No.: US 6,851,826 B2
(45) Date of Patent: Feb. 8, 2005

(54) PORTABLE ILLUMINATING DEVICE FOR INTERIOR AND EXTERIOR USE

(76) Inventor: Rose T. James, #18 Mariners Bay, 2850 Ocean Shore Blvd., Ormond Beach, Volusia, FL (US) 32176

( * ) Notice: Subject to any disclaimer, the term of this patent is extended or adjusted under 35 U.S.C. 154(b) by 3 days.

(21) Appl. No.: 10/206,462

(22) Filed: Jul. 29, 2002

(65) Prior Publication Data

US 2004/0017683 A1 Jan. 29, 2004

(51) Int. Cl.[7] ..... F21V 33/00
(52) U.S. Cl. ..... 362/156; 362/154; 362/311; 362/355
(58) Field of Search ..... 362/154, 155, 362/156, 31, 253, 311, 351, 355, 360, 361

(56) References Cited

U.S. PATENT DOCUMENTS 3,307,027 A * 2/1967 Lins et al. ..... 362/155
4,332,007 A * 5/1982 Gibstein et al. ..... 362/200
4,654,763 A * 3/1987 Knight ..... 362/156
4,742,438 A * 5/1988 King ..... 362/156
5,424,926 A * 6/1995 Myers ..... 362/156
5,685,630 A * 11/1997 Herman ..... 362/155
6,508,568 B1 * 1/2003 Blue-Recio ..... 362/156

* cited by examiner

*Primary Examiner*—Thomas M. Sember

(57) ABSTRACT

This is a two piece portable illuminating container with both pieces having the ability of being manufactured in various lengths, widths and depths and with a vertical wall of at least 3 inches high. This vertical wall keeps items placed in to it from falling out. The floor of the top unit acts as a diffusing panel to completely illuminate the device when the light assembly is energized. It makes it easy to transfer the unit in its entirety from one enclosure to another. Since this unit is self contained it can be utilized as a free standing illuminated container. It has a battery power and a light source which is activated by an automatic or manual external switch.

2 Claims, 7 Drawing Sheets

3
4
1&2
6
1
5
5
1
5
5
2
5a
5a
5a
5a
2
6
3
4
3
6
4

PORTABLE ILLUMINATING DEVICE FOR INTERIOR AND EXTERIOR USE

FIELD OF THE INVENTION

Illumination light from the interior of handbags, tackle boxes, tool boxes, or any interior enclosure or to be used independently by it's self.

DESCRIPTION OF THE PRIOR ART

Nothing of similarity has been found that is an interchangeable, versatile, lighted, semi-rigid liner for any utilitarian box, bag, satchel, case or container or more specifically can be utilized by its self as a self-contained lighted container.

BACKGROUND OF THE INVENTION

This invention relates to a two piece device having an interior/exterior illuminating means, and more specifically, a device that is removable from one enclosure to another or to be utilized by it's self as an independent light source as a self-contained device, therefore illuminating light from the bottom and completely distributing light throughout the entire self-contained device. It consists of two parts. A bottom part to contain a light source (bulb) a battery and a switch mounted on the side to engage the light. An option will be delay timer that once the switch is engaged the light will stay on for a determined length of time and then automatically turn off, therefore eliminating the possibility of forgetting to turn the switch off and running down the battery. This bottom portion is but not limited to a size of 10 inches long, 1 inch high and 3 inches wide and is made of translucent or clear plastic. The top portion is but not limited to a size of 10 inches long, 3 inches high and 3 inches wide. It snugly fits into the bottom portion where as the light is transmitted through it and transmits light evenly throughout the top portion.

This invention relates to but not limited to enclosures and has an interior illuminating means, and more specifically, to be a removable device to adapt from one enclosure to another and made of a variety of lengths and widths to accommodate a wide range of sizes and forming an integral part thereof for completely illuminating e.g. a handbag from the bottom.

The present invention has application to many uses e.g. physicians bags, tote bags, make-up cases, tackle boxes for night fishermen, or used by it's self as a self contained illuminating container.

This illuminating device is a two piece apparatus with the top portion having the ability of being manufactured in various lengths, widths and depths with a vertical wall of a least 3 inches high. This vertical wall keeps items placed into it from falling out. It also makes it easy to transfer the unit from one bag to another by keeping the items placed into in tact. It is inset at the bottom ½ an inch and has two indentations on each side of the horizontal side to receive the bottom piece of the device that has matching indentations to receive the top portion of the unit and hold it securely in place as one unit.

The bottom portion of this illuminating device is approximately 1 inch high also has the ability to be manufactured into a variety of lengths and widths to conform to the size of the top portion. It contains at least one light source and is battery operated and has a switch on the side wall or a variable length vertical switch to accommodate various heights of containers. This switch could also be manufactured to automatically activate the light upon opening the container. This bottom portion has two convex indentations on the horizontal side approximately ¼ of an inch from the top to receive the concave indentations of the top portion of the unit and hold it securely together and therefore has the ability of being moved from one enclosure to another by of staying together. The changing of the battery, when needed, is simple and easy by removing the top portion.

One of the objects of the present invention is to present a two piece self-contained illuminating device that can be utilized in the interior of an enclosure such as a handbag or by it's self as an illuminating container, e.g. in an automobile to place coins or tokens or a tackle box for night fishing.

Another objection of the present invention is to present a self-contained illuminating device that can be easily utilized and moved from one enclosure to another e.g. from one hand bag to another. When used in the interior of a handbag and with the light source being in the bottom of this device, it completely illuminates the interior of the handbag without creating any shadows within.

A still further objection of the present invention is to present a self-contained illuminating device having a top of at least 3 inch walls completely surrounding it and enabling items to be placed into it without falling out and having the ability to completely illuminate the entire surface and having clear visibility to see everything that is placed into it.

These and other objects of the present invention will be seen from reading the following detailed description of the preferred embodiments and viewing the drawings.

DETAILED DESCRIPTION OF THE PREFERRED EMBODIMENTS

Figure 1:
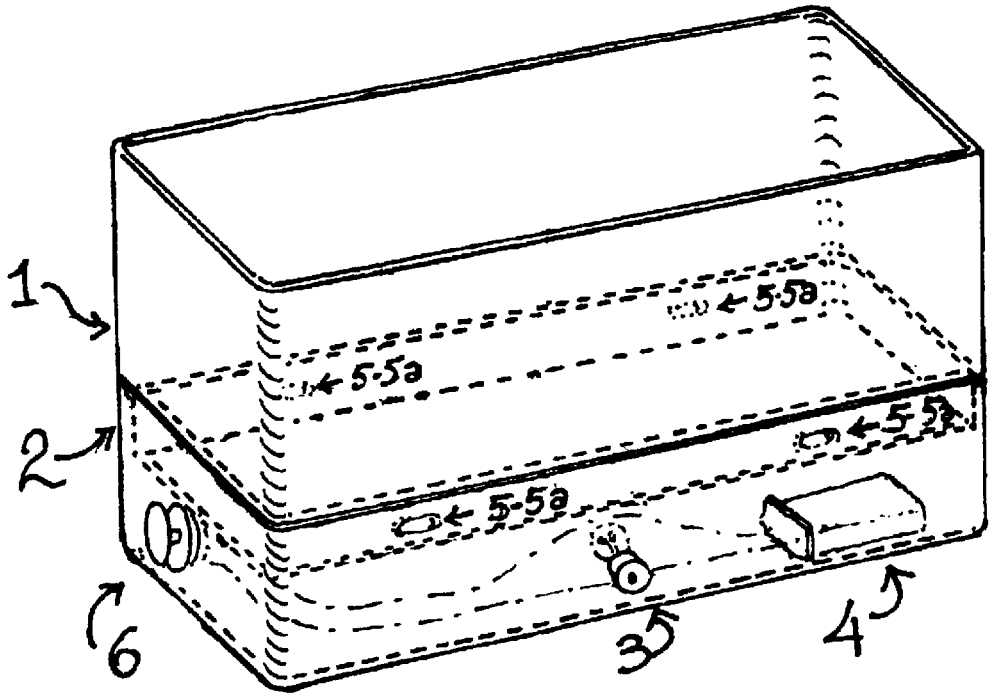
FIG. 1 is a perspective view of the two piece illuminating container showing the arrangement of switch, light, battery and showing the convex and concave indentations that hold the two pieces together, therefore securing them as one unit.
Figure 2:
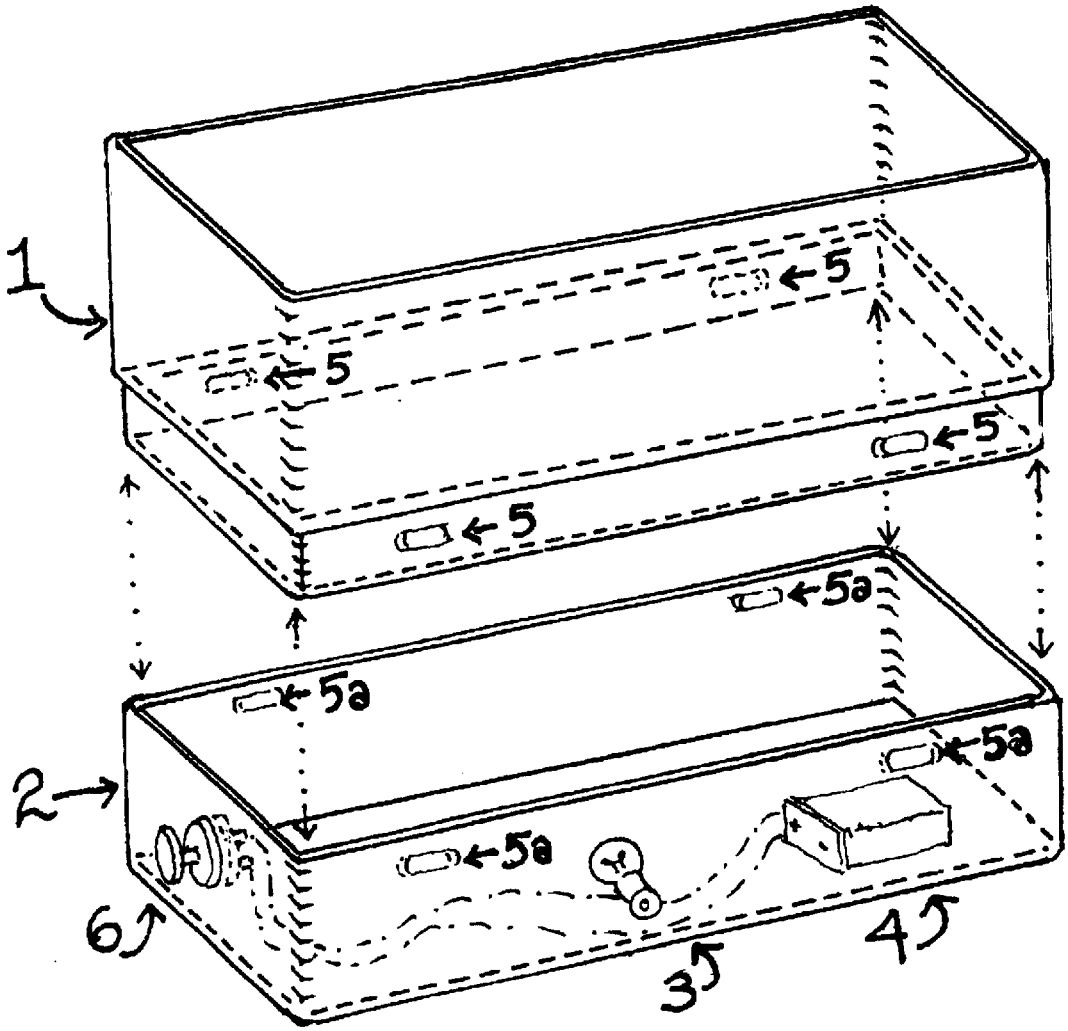
FIG. 2 is an exploded view of the two pieces showing the relationship of one to the other.

Referring now to FIGS. 1 and 2 which illustrate a first embodiment of the subject invention in which the illuminating device is constructed as a separate part of any type enclosure. An upper assembly 1 has four sidewalls and a bottom constructed of a flexible semi rigid material forming the top portion of the unit. The lower assembly 2 has four sidewalls and a bottom constructed of a semi rigid material forming in the bottom portion of the unit which contains a switch 6, a incandescent light bulb 3, a power supply 4 (battery). The two assemblies are joined with the concave and convex indentations 5 and 5*a*.

Figure 3:
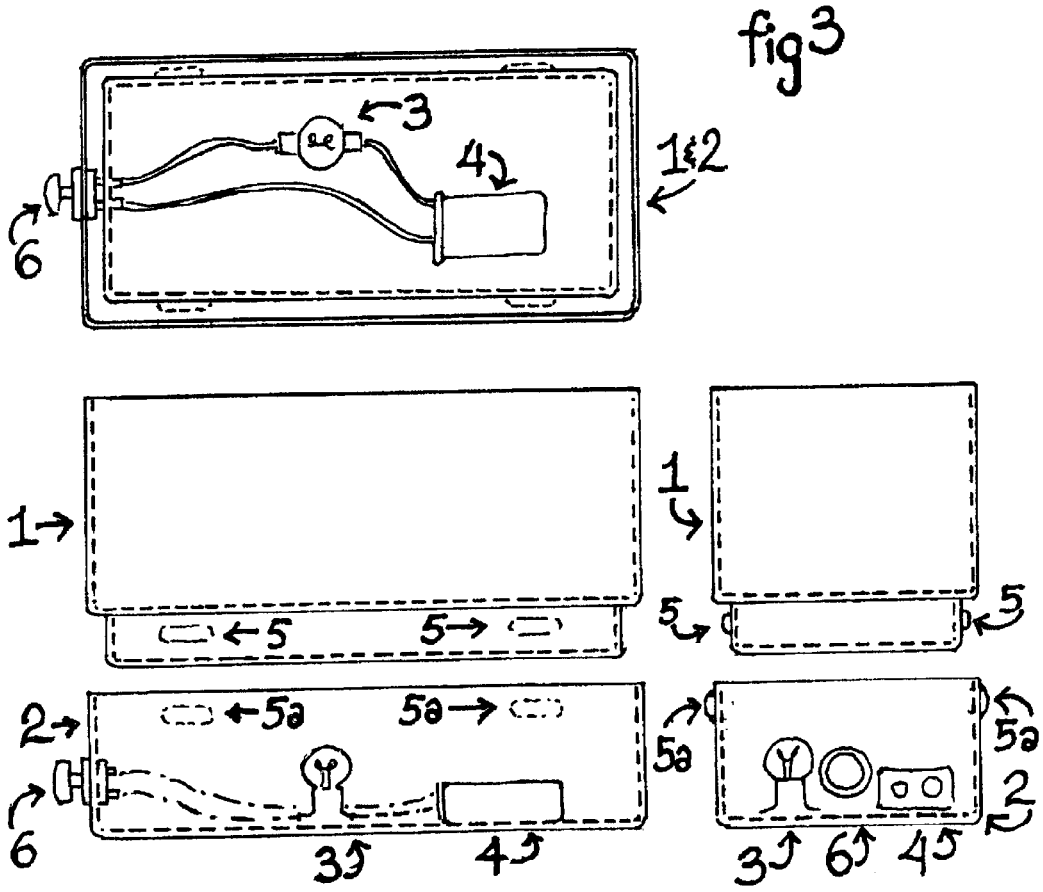
FIG. 3 is a mechanical drawing of the device showing three views of the device.
Figure 4:
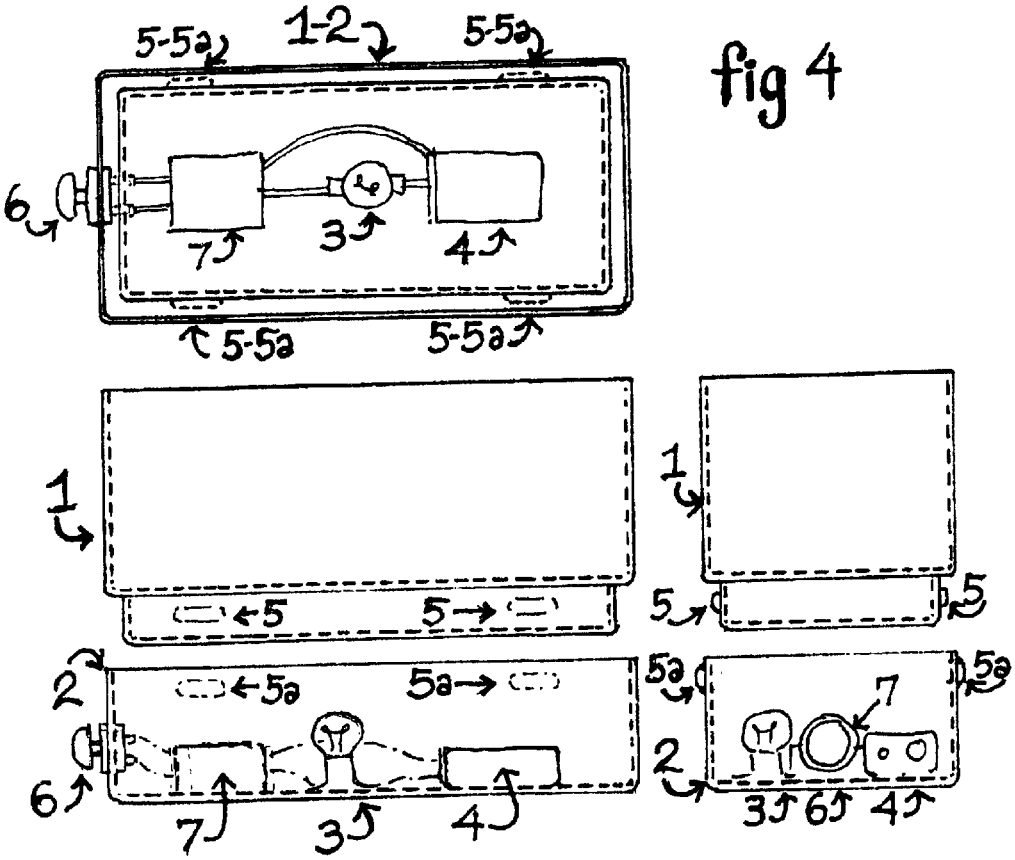
FIG. 4 is a mechanical drawing of the device showing three views including the time delay option number 7 in the drawing.

Referring now to FIG. 3 the illuminating device of the subject invention in the upper assembly 1 is formed so that the translucent plastic bottom will suitably transmit the defused light from the lower assembly 2. The unit is activated by a manual switch 6 and can be delayed electronically as an option as shown in FIG. 4 number 7.

Figure 5:
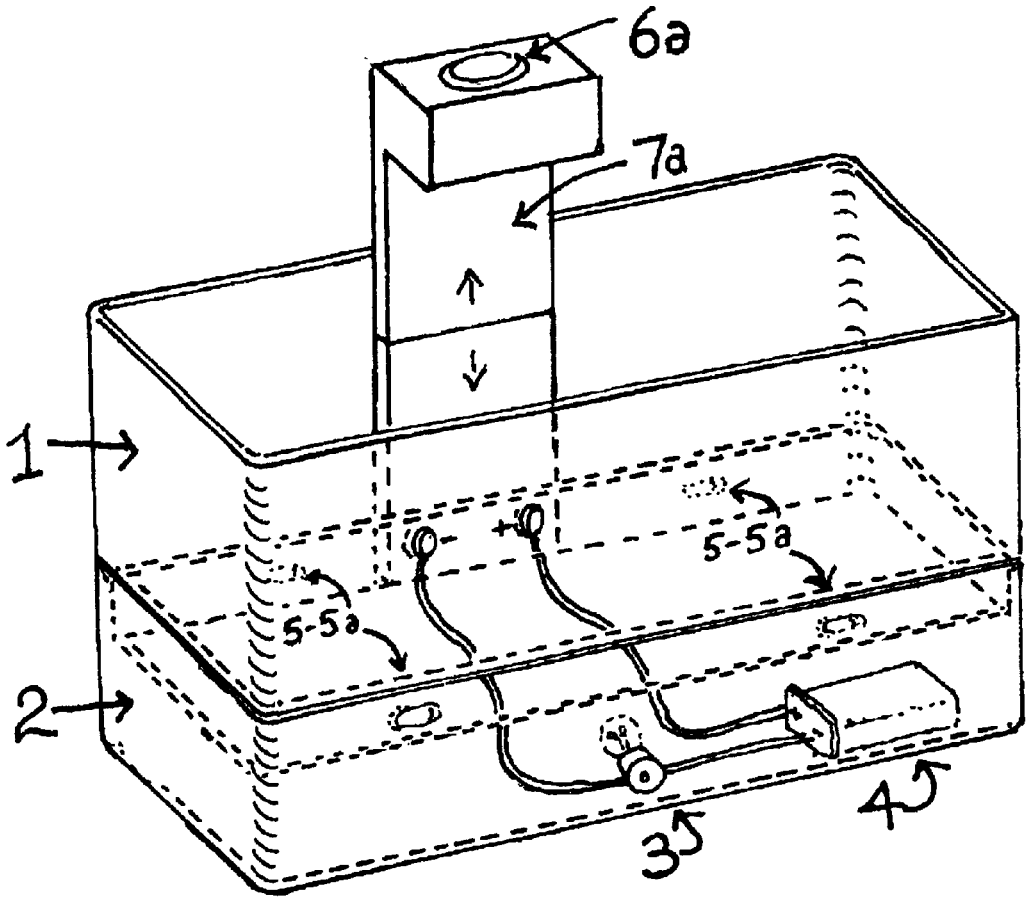
FIG. 5 is a perspective view of the device showing a vertical switching option.

Referring now to FIG. 5 is a perspective view of the optional vertical switch 6*a* and adjustable telescoping extension 7*a*.

Figure 6:
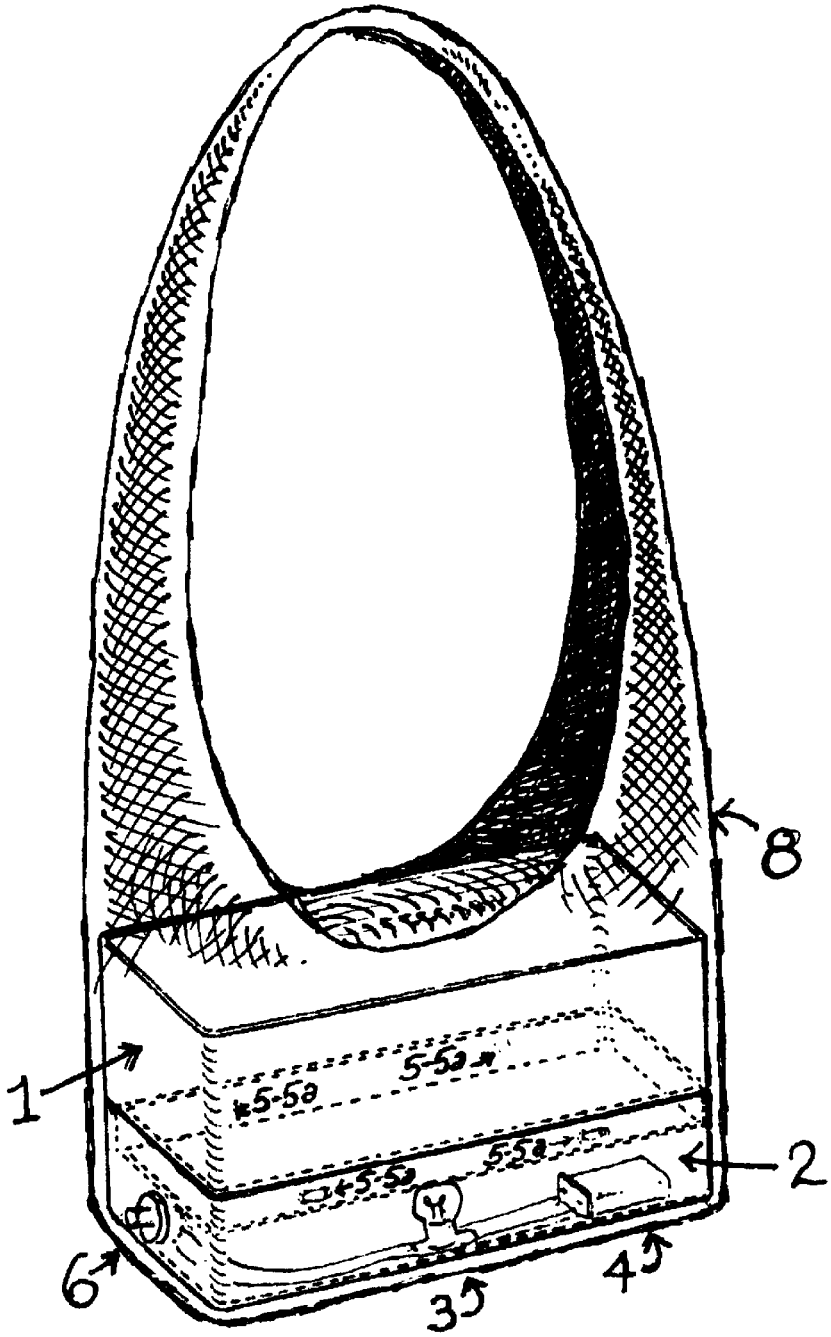
FIG. 6 is a perspective view of a ladies handbag with the illuminating device used in the embodiment.

Referring now to FIG. 6 the drawing shows the unit employed in a ladies, soft porous material handbag allowing the entire illuminating device 1 and 2 to create the shape of the purse. The switch 6 protrudes through the mesh of this material for easy accessibility for turning on and off. This switch can also be time delayed for staying on for a specified period of time.

Figure 7:
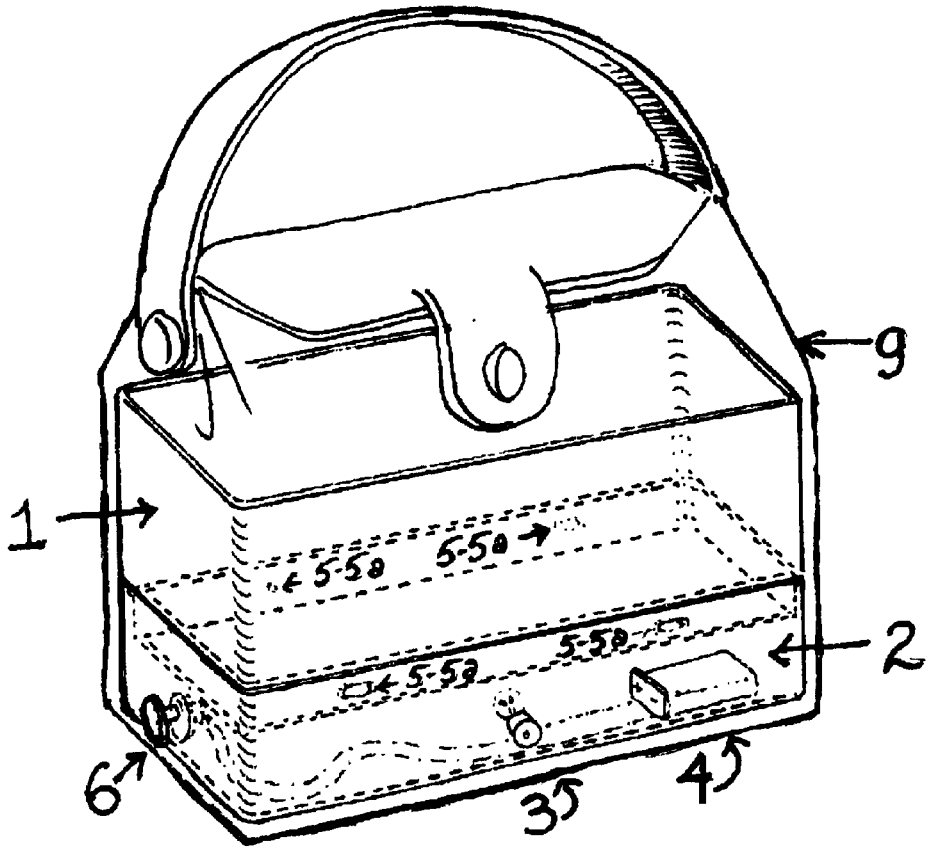
FIG. 7 is a perspective view of a satchel with the illuminating device enclosed within the interior bottom and side walls

Referring now to FIG. 7 the drawing shows the exploded view of a rigid satchel with the illuminating device 1 and 2 incorporated into a rigid walled enclosure with the switch 6 exposed through the exterior which is spring loaded and remains light while the switch is depressed. This switch can also be time delayed and have the capability of staying lit for a specified period of time.

It will be appreciated that the above information is not intended to be limiting and that modifications may be made without departing from the spirit of the invention.

What is claimed is:

1. An illuminated container which is inserted into an enclosure to identify objects in said enclosure in darkened conditions comprising:

an upper and lower assembly made of a semi-rigid but flexible translucent plastic; said upper assembly being primarily a walled container with a translucent floor which when illuminated in a dark or semi-dark environment silhouettes any object on said floor and lights all the objects in the enclosure, the lower assembly containing a momentary switch, a light source and a power source;

the upper assembly being attached to the lower assembly by applying a nominal pressure to the sides of the flexible plastic walls which have interlocking depressions at the bottom of the top unit and the top of the bottom assembly;

the illumining container being activated by depressing an exposed momentary switch on the outside of the container which may or may not protrude through the enclosure;

wherein the illuminated container can be removed from the enclosure and placed in a similar enclosure, used as an independent free standing container or can be manufactured to any suitable size.

2. The illuminated container of claim 1 wherein the lower unit includes a delay timing circuit for powering the light source.

* * * * *